US007032756B2

(12) United States Patent
Wylie

(10) Patent No.: US 7,032,756 B2
(45) Date of Patent: Apr. 25, 2006

(54) CONTAINER

(76) Inventor: Arun M. Wylie, 23024 Saddle Peak Rd., Topanga, CA (US) 90290

( * ) Notice: Subject to any disclaimer, the term of this patent is extended or adjusted under 35 U.S.C. 154(b) by 0 days.

(21) Appl. No.: 09/547,249

(22) Filed: Apr. 11, 2000

(65) Prior Publication Data

US 2003/0188986 A1 Oct. 9, 2003

(51) Int. Cl.
*B65D 21/036* (2006.01)
*B65D 25/14* (2006.01)
*B65D 25/30* (2006.01)

(52) U.S. Cl. ..... 206/509; 206/508; 220/495.02; 220/23.6; 220/608; 220/771

(58) Field of Classification Search ..... 220/752, 220/755, 768, 771, 495.02, 23.6, 304, 608, 220/23.2; 206/503, 508–512
See application file for complete search history.

(56) References Cited

U.S. PATENT DOCUMENTS

| | | | | |
|---|---|---|---|---|
| D34,895 | S | | 8/1901 | McFaddin |
| 2,194,486 | A | | 3/1940 | Straub |
| 2,324,338 | A | | 7/1943 | Tripp |
| 2,659,519 | A | | 11/1953 | Allen |
| 2,707,574 | A | | 5/1955 | Klebenow |
| 2,743,844 | A | | 5/1956 | Livingstone |
| 2,763,402 | A | | 9/1956 | Livingstone |
| 2,817,465 | A | | 12/1957 | Gray |
| 2,851,196 | A | | 9/1958 | Livingstone |
| 3,000,527 | A | | 9/1961 | Jennings et al. |
| D192,886 | S | | 5/1962 | Kaplan |
| D206,407 | S | * | 12/1966 | Sharp ..... D9/531 |
| 3,310,088 | A | | 3/1967 | Hildebrandt et al. |
| D207,466 | S | | 4/1967 | Phillips |
| 3,313,438 | A | | 4/1967 | Piker |
| 3,387,749 | A | | 6/1968 | Godshalk et al. |
| D211,928 | S | | 8/1968 | Burnett |
| D217,231 | S | | 4/1970 | Pashman |
| D221,515 | S | | 8/1971 | Betka |
| 3,612,595 | A | | 10/1971 | Updegraff et al. |
| 3,620,410 | A | | 11/1971 | Griese |
| 3,625,386 | A | | 12/1971 | Schaefer |
| 3,659,758 | A | | 5/1972 | Waterman |
| 3,695,488 | A | | 10/1972 | Olsson |
| 3,727,792 | A | | 4/1973 | Levin |
| 3,744,671 | A | | 7/1973 | Saunders |
| 3,807,679 | A | | 4/1974 | Burke et al. |
| 3,899,107 | A | | 8/1975 | Gaal |
| 3,927,797 | A | * | 12/1975 | Flider ..... 220/318 |
| 3,938,686 | A | | 2/1976 | Milligan et al. |
| 3,945,527 | A | | 3/1976 | Pylant |
| 4,014,465 | A | | 3/1977 | Ritter |
| 4,022,352 | A | | 5/1977 | Pehr |
| 4,061,242 | A | | 12/1977 | Donlon |
| 4,078,700 | A | | 3/1978 | Hidding |
| 4,128,189 | A | | 12/1978 | Baxter |
| D250,806 | S | | 1/1979 | Gutkowski |
| 4,150,763 | A | | 4/1979 | Simpson |
| 4,203,537 | A | | 5/1980 | McAlister |
| 4,225,064 | A | | 9/1980 | Westcott |

(Continued)

*Primary Examiner*—Nathan J. Newhouse
*Assistant Examiner*—Niki M. Eloshway
(74) *Attorney, Agent, or Firm*—Schwegman, Lundberg, Woessner & Kluth, P.A.

(57) ABSTRACT

The present invention relates to containers, and more specifically, to plastic containers. The containers described herein may be applied to any use, but they are particularly useful for storing paint.

11 Claims, 5 Drawing Sheets

U.S. PATENT DOCUMENTS 4,240,568 A 12/1980 Pool
D258,563 S 3/1981 Romagnoli
D261,362 S 10/1981 Epperson
4,312,459 A 1/1982 Leach
4,386,701 A * 6/1983 Galer ..... 206/509
4,387,828 A 6/1983 Yates
4,387,922 A 6/1983 Geisinger
D269,948 S 8/1983 Janssen
4,399,926 A 8/1983 Eidels-Dubovoy
4,453,647 A 6/1984 Neat
4,457,458 A 7/1984 Heinol
4,458,819 A 7/1984 Geiger
D276,890 S 12/1984 Hancher
4,491,234 A 1/1985 Wilcock
4,494,674 A * 1/1985 Roof ..... 220/784
4,520,936 A 6/1985 Lyons
D279,763 S 7/1985 Hestehave et al.
4,530,442 A 7/1985 Vogel, Jr.
4,541,529 A * 9/1985 Hestehave et al. ..... 206/510
4,548,332 A 10/1985 Neat
D281,579 S 12/1985 Drummond et al.
4,583,666 A 4/1986 Buck
4,619,373 A 10/1986 Galer
D289,377 S 4/1987 Ashby et al.
4,655,363 A 4/1987 Neat
4,664,295 A 5/1987 Iida
4,671,421 A 6/1987 Reiber et al.
4,706,829 A 11/1987 Li
4,735,313 A * 4/1988 Schoenberg ..... 220/771
4,736,874 A 4/1988 Durant
D296,873 S 7/1988 Dent et al.
4,771,501 A * 9/1988 Leiter ..... 15/104.92
4,773,560 A 9/1988 Kittscher
4,805,793 A * 2/1989 Brandt et al. ..... 206/509
4,830,234 A 5/1989 Odet
D304,014 S * 10/1989 O'Connell ..... D9/522
D305,407 S 1/1990 Gonda
4,893,723 A 1/1990 Seabolt
4,899,885 A * 2/1990 Van Koert ..... 206/512
4,911,319 A 3/1990 DeJean
D307,389 S * 4/1990 Larson ..... D9/520
4,917,268 A 4/1990 Campbell et al.
4,927,046 A 5/1990 Armstrong
4,928,860 A * 5/1990 Knight ..... 220/771
D309,260 S * 7/1990 Conrad ..... D9/528
4,941,815 A 7/1990 Julian
4,949,884 A 8/1990 Dahl
4,974,749 A 12/1990 Mon
D313,350 S 1/1991 Beaver
4,984,714 A 1/1991 Sledge
5,020,692 A 6/1991 Darr
D318,228 S 7/1991 Schlesselman
D320,345 S 10/1991 Hamly et al.
D321,624 S 11/1991 Fiore et al.
5,064,101 A * 11/1991 Richter et al. ..... 206/510
D323,115 S 1/1992 Kelsey
5,092,474 A 3/1992 Leigner
5,092,478 A 3/1992 La Pierre
5,105,858 A * 4/1992 Levinson ..... 141/2
5,108,009 A 4/1992 Davidson et al.
D332,747 S 1/1993 Darr et al.
5,188,249 A 2/1993 Cargile
5,207,356 A 5/1993 Krall
D336,434 S 6/1993 Binder
D338,407 S 8/1993 Lynd
5,234,130 A 8/1993 Benioff et al.
5,269,438 A * 12/1993 Kelsey ..... 220/766
5,299,710 A 4/1994 Welsch et al.
5,303,839 A 4/1994 Blumenschein
5,322,662 A 6/1994 Benioff et al.
D349,651 S 8/1994 Saffer
D352,459 S 11/1994 Pollacco
5,377,858 A 1/1995 Morris
5,383,558 A 1/1995 Wilkinson et al.
D355,366 S 2/1995 Bainton
5,390,805 A 2/1995 Bilani et al.
5,401,200 A * 3/1995 Ellis ..... 446/71
5,409,128 A 4/1995 Mitchell
D358,333 S 5/1995 Stockwell et al.
5,431,306 A 7/1995 Reid
D360,830 S * 8/1995 Hestehave et al. ..... D9/520
D362,180 S 9/1995 Haines
5,492,240 A * 2/1996 Vilutis ..... 220/62.11
D370,153 S 5/1996 Chaney et al.
D370,850 S 6/1996 Beaver
D372,197 S 7/1996 Gough
D374,178 S 10/1996 Valls et al.
5,566,861 A 10/1996 Serano
5,566,862 A 10/1996 Haffner et al.
5,577,626 A 11/1996 Henkel et al.
D376,761 S 12/1996 Lathrop et al.
5,603,787 A 2/1997 Reid
D379,302 S 5/1997 Rodman
5,626,258 A 5/1997 Maiorino
5,669,526 A 9/1997 Keyfauver
5,678,684 A 10/1997 Wright
5,699,925 A * 12/1997 Petruzzi ..... 206/509
D389,067 S 1/1998 Lown
5,704,502 A 1/1998 Greenfield
D392,188 S 3/1998 Darr et al.
5,743,425 A * 4/1998 Ellis ..... 220/254.2
5,775,483 A * 7/1998 Lown et al. ..... 206/508
5,794,803 A 8/1998 Sprick
RE35,933 E 10/1998 Scholl
5,823,345 A 10/1998 Nask et al.
D401,154 S 11/1998 Robinson
D403,243 S 12/1998 Takeuchi et al.
5,850,953 A 12/1998 Dallas
5,855,299 A 1/1999 Arnold et al.
5,855,304 A 1/1999 Dean et al.
5,860,559 A 1/1999 Wang
5,868,283 A 2/1999 Wilson et al.
5,875,942 A 3/1999 Ohmi et al.
5,893,489 A 4/1999 Giarrante
5,896,993 A * 4/1999 Nask et al. ..... 206/508
5,908,136 A * 6/1999 Mrak ..... 220/771
5,941,427 A 8/1999 Speer
5,964,383 A 10/1999 Cargile
5,967,378 A 10/1999 Arispe
5,971,201 A 10/1999 Daw
5,975,346 A 11/1999 Imperato et al.
6,029,858 A 2/2000 Srokose et al.
6,029,864 A * 2/2000 Nilsson et al. ..... 220/771
D422,920 S 4/2000 Tapp et al.
6,059,153 A 5/2000 Olson et al.
6,068,161 A 5/2000 Soehnlen et al.
6,085,949 A 7/2000 Zimny et al.
D428,817 S 8/2000 Olson et al.
6,123,231 A 9/2000 Geisinger
6,209,762 B1 4/2001 Haffner et al.
6,223,945 B1 5/2001 Giblin et al.
D449,535 S 10/2001 Geisinger et al.
6,412,661 B1 * 7/2002 Hannah, Sr. ..... 222/111
6,530,500 B1 3/2003 Bravo et al.

* cited by examiner

CONTAINER

BACKGROUND OF THE INVENTION

The present invention relates to containers, and more specifically, to plastic containers. The containers described herein may be applied to any use, but they are particularly useful for storing paint, varnish, stain and the like. The containers of the invention will be described in connection with the use of storing paint with the understanding that the container has other usages, such as storing food or other contents.

Paint is conventionally stored and sold in metal cans which have an upper edge with a groove in which an annular edge of a metal cover is secured by a press fit. The cover is typically removed by prying an edge of the cover upwardly out of engagement with the can edge so that the stored paint can be used. The cover is usually pried upwardly with a screwdriver or other pointed device. The cover can be resecured onto the can by press fit, typically by striking the lid with a solid object, such as a hammer. Because the paint frequently fills the groove of the can, striking the lid with a hammer oftentimes causes the paint to spray outwards. Further, any paint that remains in the groove prevents a tight securing of the cover.

Paint has generally been stored in round metal containers because the density and weight of paint has been too great for polymeric-based containers to contain and because of a reactivity of the paint with polymeric containers. Round-shaped cans have been used to store paint because it has been difficult to fabricate metal containers with symmetries that are not round.

Notwithstanding the widespread use of round metal cans as containers for paint, the use of those cans has been expensive and wasteful with respect to storage and transport. For example, round metal cans cannot be positioned efficiently. Further, round metal cans add significant weight to the paint product. Round metal cans are typically difficult to open and close, and round metal cans are difficult to carry. Round metal cans are also easily be dented. Moreover, problems are associated with reclosing the round metal can after use since paint has most likely filled the channel groove portion of the can which receives the standard lid, resulting in spray, spillage and disrupted resealing.

Efforts have been made to utilize paint containers manufactured from materials other than paint. For example, plastic paint containers are reported in U.S. Pat. Nos. 3,938,686; 4,453,647; 4,530,442; 4,548,332; 4,619,373; 4,655,363; 5,303,839; and 5,975,346. However, a need still exists for a paint container that can be easily and efficiently transported, stored, positioned, opened, closed and carried by hand. In securing the cover in position, it is important that the cover is both securely attached and readily removed when desired. Further, the container should be designed not only to store the paint, but also to prevent undesired escape of the paint, to prevent the ingress of dust, moisture or other materials into the container, to allow opening without special tools and to allow tight resealing.

SUMMARY OF THE INVENTION

One embodiment of the present invention includes a polymeric container. The polymeric container comprises a main body. The main body includes a neck portion, a bottom portion and a handle portion. The bottom portion defines a lug. One other embodiment further includes a lid positionable over the neck. The lid defines indentations capable of receiving lugs from another polymeric container. In another embodiment, the main body defines an indentation capable of receiving one or more lugs.

Another embodiment includes a method for stacking containers. The method comprises providing a first container comprising a main body with a bottom portion. The bottom portion defines one or more lugs. A second container is also provided. The second container comprises a main body that defines an indentation and a bottom portion. The bottom portion defines one or more lugs. The first container is stacked on the second container so that the lug of the first container is seated within the indentation of the second container.

One other embodiment of the present invention includes a method for stacking containers. The method comprises providing a first container with a main body that includes a bottom portion. The bottom portion defines one or more lugs. The method also comprises providing a second container and a lid positioned on the container. The lid defines an indentation. The first container is stacked on the second container so that the lug of the first container is seated within the indentation on the lid.

DETAILED DESCRIPTION

Figure 1:
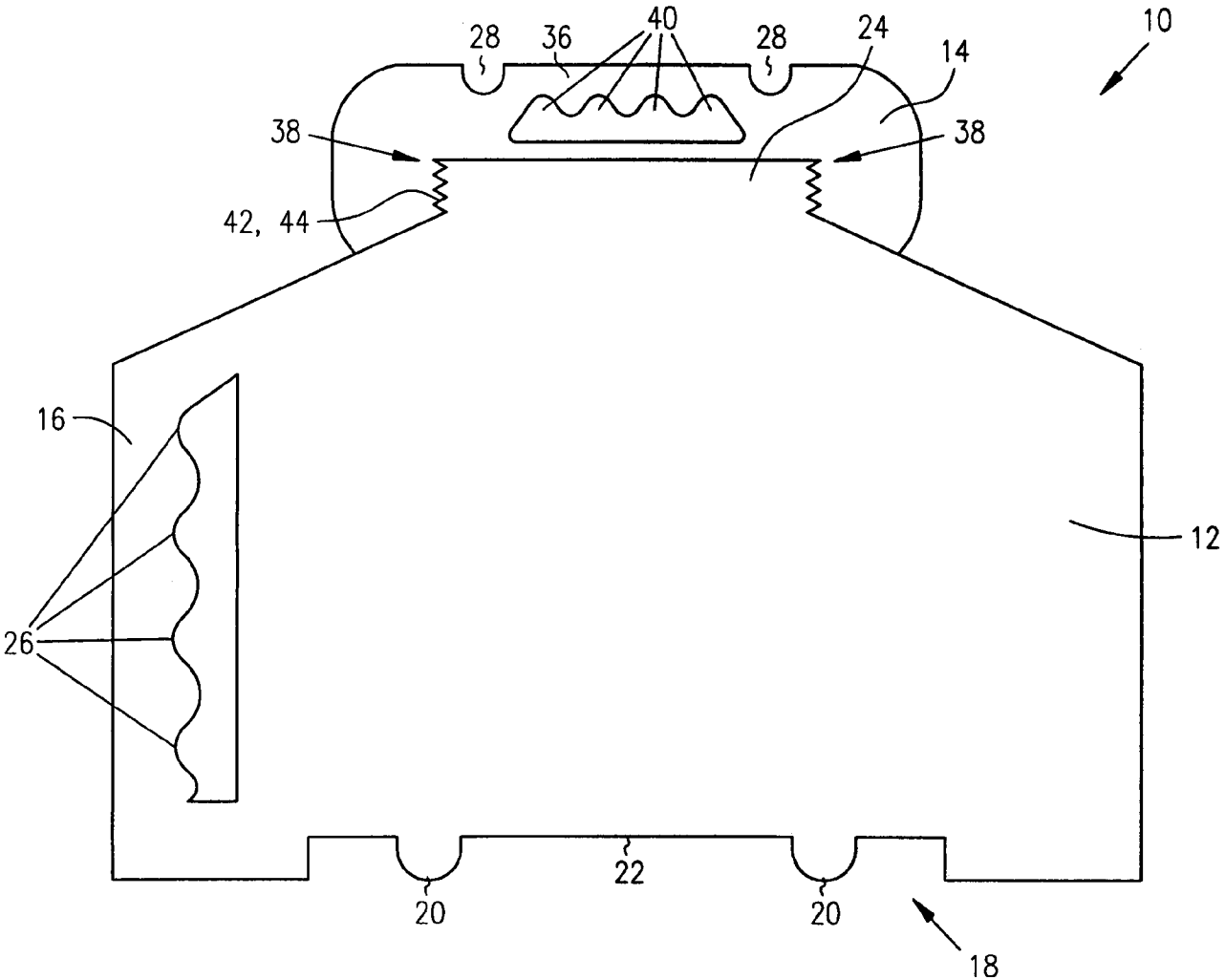
FIG. 1 is a perspective view of one embodiment of the container of the present invention.

One embodiment of the container of the present invention, illustrated generally at 10 in FIG. 1, includes a main body 12 with a generally parallelpiped shape and a lid 14 attachable to the main body 12 at a neck 24. The main body 12 comprises the neck 24, a handle 16, and a bottom portion 18 with an annular lug 20 and a central indentation 22. Although the container depicted represents a paint volume content of approximately one gallon, the container is readily manufactured in different sizes. The container of the present invention is not limited to any one volume or dimension.

Figure 2:
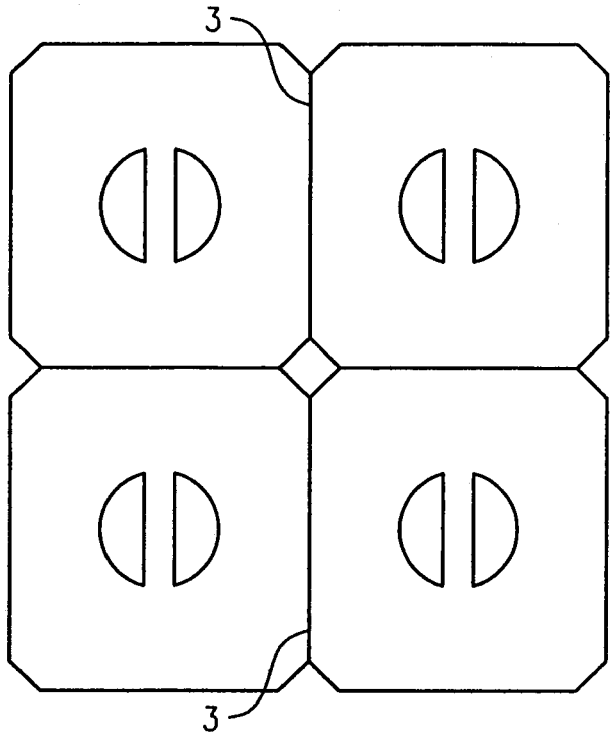
FIG. 2 is a top plan view of a plurality of the containers positioned for transport or storage.

The container of the present invention includes a number of features that render the container more easily and efficiently stored and transported than conventional containers, such as round metal paint containers. One of these features is the symmetry of the main body. The main body of the container of the present invention is a parallelpiped that permits the container to be transported with a minimum of free space. Straight sidewalls of adjacent containers are alignable with each other, as is shown at 3 in FIG. 2. The container of the present invention also includes a number of features that render the container more easily and efficiently opened and closed than conventional containers.

The container of the present invention 10 includes a unitary handle 16 that forms indentations for fingers 26 that enable a user to more easily carry the container 10. One embodiment of the container 10 includes an annular lug 20 that permits more stable stacking of the container 10. In particular, the lug 20 is insertable in an annular groove 28 defined within one embodiment of the lid 14.

Figure 5A:
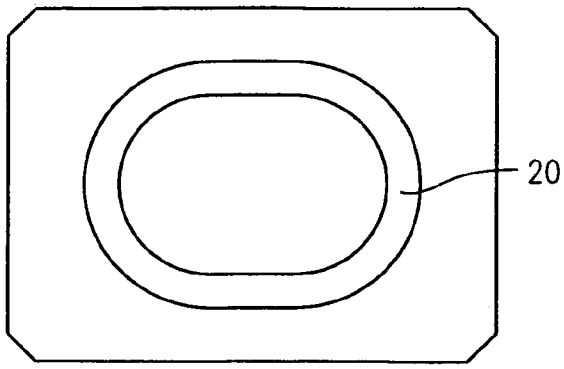
FIG. 5*a* is a top plan view of another embodiment of the bottom portion of the container of the present invention with an annular lug in a main body of the container.
Figure 5B:
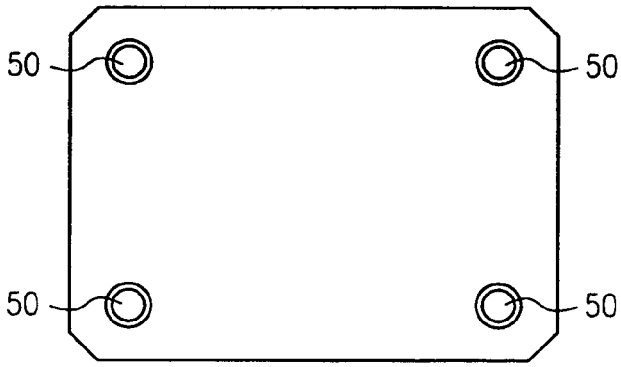
FIG. 5*b* is a top plan view of one other embodiment of the bottom portion of the container of the present invention with a plurality of discrete lugs in the main body of the container.
Figure 5C:
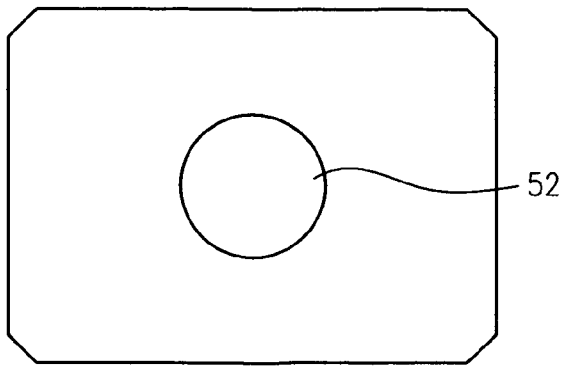
FIG. 5*c* is a top plan view of another embodiment of the bottom portion of the container of the present invention with a single centrally positioned lug.

The shape of the lug 20 can be varied for other container embodiments. For example, the lug may be a continuous annular lug, such as is shown at 20 in FIG. 5*a* or may be a discrete lug such as is shown at 50 in FIG. 5*b*. The lug may also be a single lug 52 positioned in a central region of the bottom of the container, as shown in FIG. 5*c*. Although four lugs are shown, in FIG. 5*b*, it is understood that more or fewer lugs are suitable for use. The lugs 20, 50, and 52 have shapes ranging from rectangular to ovoid.

Figure 6A:
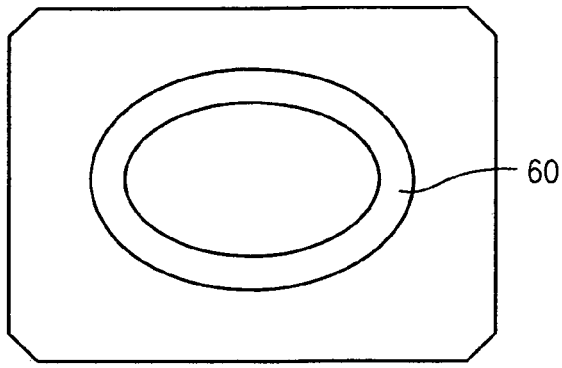
FIG. 6*a* is a tp plan view of a top portion of one embodiment of the container of the present invention wherein the main body defines an annular indentation.
Figure 6B:
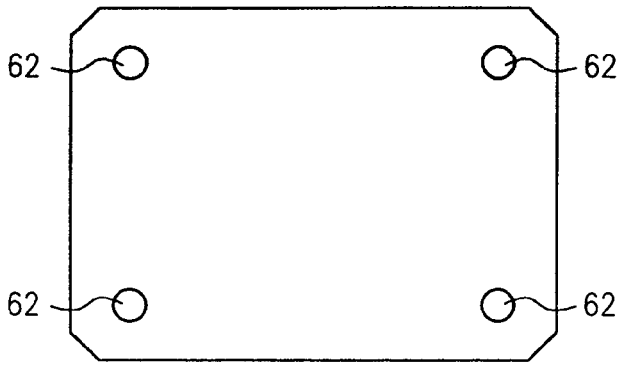
FIG. 6*b* is a top plan view of a top portion of one embodiment of the container of the present invention wherein the main body defines a plurality of discrete indentations.
Figure 6C:
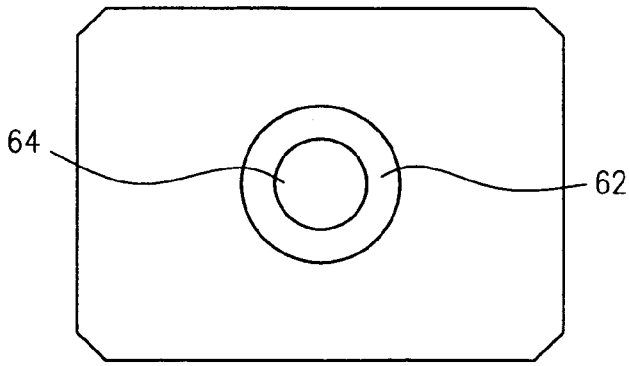
FIG. 6*c* is a top plan view of one embodiment of a container and lid of the present invention wherein an indentation is defined by the lid.

The shape of the groove 28 defined is of a shape that permits the stacking of the containers and that permits receipt of the lug 20. This shape is an annular shape for receipt of annular lug 20 as shown at 60 in FIG. 6*a*. The groove 60 is defined by the container main body. The shape of the groove or indentation is discrete, as shown at 62 in FIG. 6*b*, for receipt of discrete lugs 50. The discrete indentations 62 are also positioned within the main body of the container. In one other embodiment shown in FIG. 6*c*, the indentation 64 is in a lid 62. The indentation receives the lug 52.

The unitary handle 16 also creates a modular shape for the container 10 that renders the container more efficient to store. The handle 16 may be hollow or solid. The handle 16 is, for some embodiments, integral with the main body.

Figure 3:
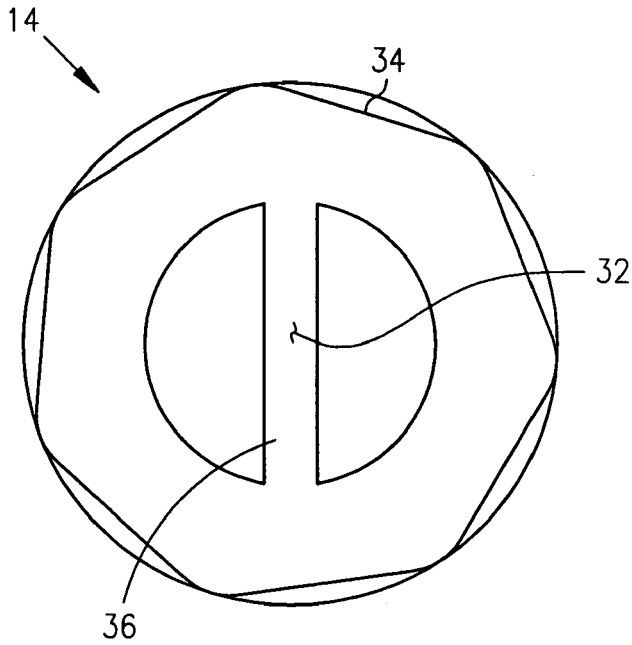
FIG. 3 is a top plan view of one embodiment of the container of the present invention.
Figure 4:
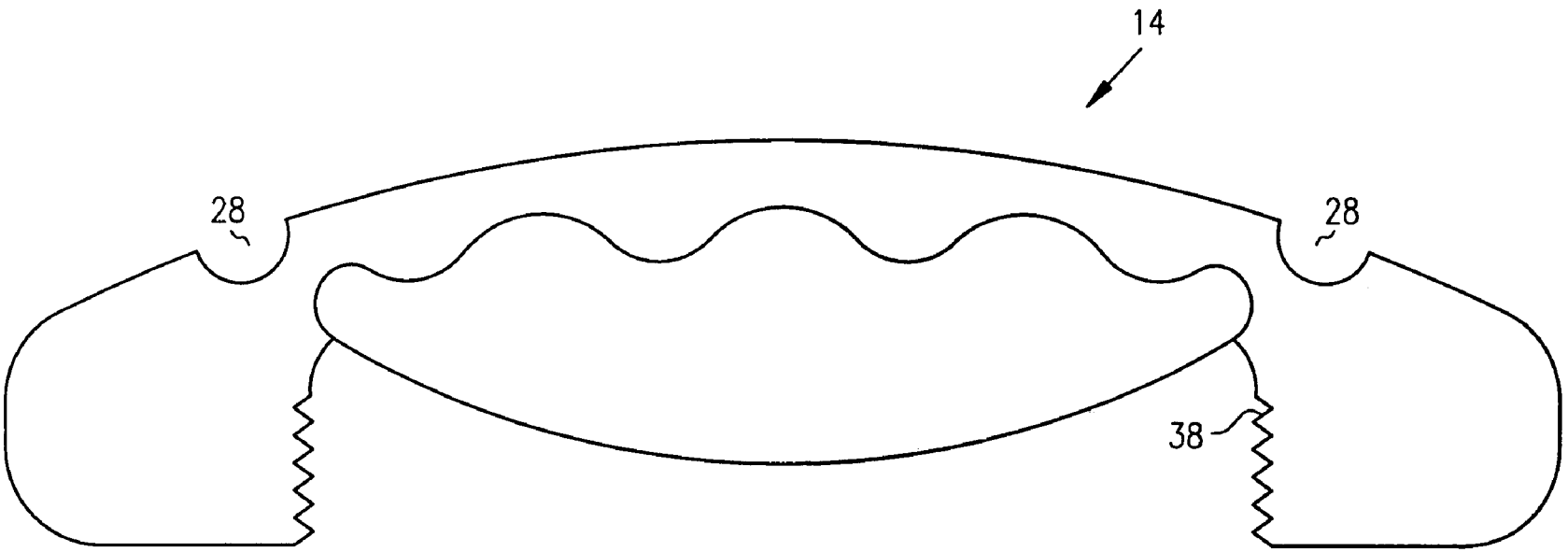
FIG. 4 is a top plan view of one embodiment of the container with an indentation for lug receipt in a lid applied to the container.

One lid embodiment is illustrated generally at 14 in FIG. 3. The lid 14 comprises two turning mechanisms, a central mechanism 32 and indentations 34. The central mechanism comprises a unitary band 36 that allows the lid 14 to be moved in clockwise and a counter clockwise directions. The band 36 has an elevation that permits fingers of a user to be placed below the band 36 to turn the lid 14. The band forms indentations 40 for fingers that enable the user to more easily carry, open and close the container. The indentations 34 are positioned and sized to enable a user to grasp the lid 14 and to turn the lid 14 clockwise and counter clockwise. The lid 14 of the present invention is configured to enable individuals with "stiff" fingers to use and to turn with relative ease. The lid 14 is sealed to the container 12 by an o-ring 38. The lid 14 defines threading 42, and the neck 24 defines threading 44, so that the threadings 42 and 44 are capable of interacting to attach the lid 14 to the main body 12.

The container of the present invention is fabricated from a polymeric material such as polypropylene with methods well known to the art worker. The handle is for some embodiments filled and for other embodiments hollow.

For some embodiments, the container is lined with a material such as a heat sealable thermoplastic or laminate which acts to contain a material such as paint and, along with the o-ring seal, to prevent air oxidation. Suitable liner materials include polyester, polyvinylidene chloride, polyethylene and the like. Other suitable liner materials include cellulosics, polycarbonates, polypropylene, polyester or metallized plastic sheet material. One liner material is a plastic laminate that includes nylon, polyvinylidene chloride, polyethylene and a 0.003 to 0.001 inch aluminum foil. The aluminum foil is sandwiched between layers of the plastic material.

In one embodiment, an aluminum foil barrier is laminated to an outer polymeric shell by a thermosealing polycoat. The polycoat thermally bonds the foil to the polymeric material. One polycoat comprises a polyethylene extrusion that is coated to the polymeric shell.

The container of the present invention is usable for storing and transporting a material such as paint. The shape of the container permits space-efficient transport. The shape of the container as well as the ergonomic features of the lid and handle render the container easy and safe for an individual to carry.

While preferred embodiments of the invention are described herein, those familiar with the art to which this invention relates will recognize various alternative designs and embodiments for practicing the present invention that do not depart from the spirit and scope of the present invention. All such modifications and variations are intended to be included within the scope of the invention, as defined by the following claims.

What is claimed is:

1. An apparatus comprising:

a first container comprising a unitary main body with a threaded neck portion and a sidewall, the unitary main body also comprising a handle portion having opposite ends each of which extend from the main body, the handle portion comprising a molded handle wherein the molded handle and the main body define an opening for receiving fingers of a human hand, the handle portion extending along the side of the unitary main body wherein the handle portion and the unitary main body define a square or rectangular perimeter of the first container;

the unitary main body further comprising a bottom portion with a recess defined centrally in the bottom portion, the recess defined by a vertical surface free of an interlocking extension and a horizontal surface extending inwardly from the vertical surface, and a lid, the lid attachable to the threaded neck portion of the unitary main body, wherein the threaded neck portion is disposed centrally with respect to the main body;

the bottom portion recess of the first container is adapted to align the first container with a lid of another container;

the lid of the first container including a planar top surface adapted to support a second container stacked thereon, and a skirt extending from the perimeter of the planar top surface, the skirt having an outer surface which is free of interlocking extensions;

the second container comprising a unitary main body with a threaded neck portion and a sidewall, the unitary main body also comprising a handle portion having opposite ends each of which extend from the main body, the handle portion comprising a molded handle wherein the molded handle and the main body define an opening for receiving fingers of a human hand, the handle portion extending along the side of the unitary main body wherein the handle portion and the unitary main body define a square or rectangular perimeter for the paint container; the unitary main body of the second container further comprising a bottom portion with a recess defined centrally in the bottom portion, and a lid, the lid attachable to the threaded neck portion of the unitary main body, wherein the threaded neck portion is disposed centrally with respect to the main body;

the recess of the second container is defined by a vertical surface adapted to align the second container with the lid of the first container, and a horizontal surface extending inwardly from the vertical surface, the vertical surface of the second container being free of interlocking extensions;

the lid of the second container including a top surface adapted to support another container stacked thereon;

wherein the horizontal surface of the second container comprises a substantial area of the bottom portion of the second container and wherein the horizontal surface of the bottom portion of the second container faces the planar top surface of the lid of the first container and wherein the second container rests on the lid of the first container and the lid of the first container supports substantially all of the weight of the second container in stable stacked arrangement, and further wherein the horizontal surface of the bottom portion of the second container is parallel to and proximate to the planar top surface of the lid of the first container; and paint that is contained in the first and second containers.

2. The apparatus of claim 1 wherein the each lid includes an o-ring positioned to seal the lid to the main body.

3. The apparatus of claim 2 wherein the each lid defines one or more discrete indentations.

4. The apparatus of claim 1 wherein the each lid comprises a unitary band.

5. The apparatus of claim 4 wherein the each unitary band defines indentations.

6. The apparatus of claim 1 wherein the each lid defines indentations.

7. The apparatus of claim 6 wherein the each handle is hollow.

8. The apparatus of claim 6 wherein the each handle is plastic-filled.

9. The apparatus of claim 8 wherein the each container is lined.

10. The apparatus of claim 1 wherein the second container is adapted so that the sidewall of the second container contacts the handle of the first container when positioned adjacent thereto and the perimeter of the first and second containers in contact is rectangular.

11. The apparatus of claim 1 wherein the each main body comprises a polymer.

* * * * *

UNITED STATES PATENT AND TRADEMARK OFFICE

CERTIFICATE OF CORRECTION

PATENT NO. : 7,032,756 B2
APPLICATION NO. : 09/547249
DATED : April 25, 2006
INVENTOR(S) : Wylie It is certified that error appears in the above-identified patent and that said Letters Patent is hereby corrected as shown below:

In column 2, line 45, Delete “tp” before “plan” and insert -- top --, therfor.

Signed and Sealed this

Eighth Day of August, 2006

JON W. DUDAS
*Director of the United States Patent and Trademark Office*